United States Patent [19]

Nevgod et al.

[11] Patent Number: 4,687,135

[45] Date of Patent: Aug. 18, 1987

[54] DETONATION-GAS APPARATUS FOR APPLYING COATINGS

[75] Inventors: Vasily A. Nevgod; Alexandr P. Garda; Valery K. Kadyrov, all of Kiev, U.S.S.R.

[73] Assignee: Institut Problem Materialovedenia Akademii Nauk Ukrainskoi SSR, Kiev, U.S.S.R.

[21] Appl. No.: 861,572

[22] Filed: May 9, 1986

[51] Int. Cl.[4] ..... B05B 1/24

[52] U.S. Cl. ..... 239/81; 137/625.4; 239/85; 239/400; 239/412; 239/415

[58] Field of Search ..... 239/79, 81, 85, 400, 239/412, 416.1, 415; 137/625.4

[56] References Cited

U.S. PATENT DOCUMENTS

| | | | |
|---|---|---|---|
| 2,869,924 | 1/1959 | Mcgill | 239/81 |
| 2,950,867 | 8/1960 | Hawley et al. | 239/85 |
| 3,150,828 | 9/1964 | Pelton et al. | 239/85 |
| 3,678,959 | 7/1972 | Liposky | 137/625.4 |
| 3,773,259 | 11/1973 | Zverev | 239/81 |
| 3,893,481 | 7/1975 | Watts | 137/625.4 |
| 4,188,974 | 2/1980 | Roger | 137/625.4 |

FOREIGN PATENT DOCUMENTS

| | | | |
|---|---|---|---|
| 68566 | 4/1983 | Japan | 137/625.4 |

*Primary Examiner*—Andres Kashnikow
*Assistant Examiner*—Michael J. Forman
*Attorney, Agent, or Firm*—Burgess, Ryan & Wayne

[57] ABSTRACT

The essence of the invention resides in that the apparatus comprises a gas distribution unit for distributing inert gas, oxidant and fuel gas, and has a cylinder provided with a headpiece. Walls of the cylinder have ports communicating its interior with gas sources, whereas the headpiece includes passages to convey gases from the interior of the cylinder to a barrel.

6 Claims, 5 Drawing Figures

DETONATION-GAS APPARATUS FOR APPLYING COATINGS

FIELD OF THE INVENTION

This invention relates generally to apparatuses for spraying and applying coatings to surfaces of bodies, and more particularly to detonation-gas apparatus for applying coatings to surfaces of bodies.

The invention can find application for applying metal, metal-ceramic, ceramic, wear-resistant, heat-resistant, electroinsulating, electroconducting and other types of coatings to machine parts and equipment of various designation. In addition, the apparatus embodying the present invention can be used for grinding powder materials, cleaning and local heating of surfaces, welding some non-metal materials and piercing holes in them, obtaining powders with new properties, producing structural changes in the surface layers of materials, and elsewhere.

At present, the ever increasing specific loads exerted on working surfaces, higher temperatures to which machine parts are subjected during operation, and more corrosive atmosphere in which they operate call for improved quality of coatings applied by utilizing detonation waves, as well as more efficient methods and devices for coating application. These requirements are met by a number of prior art apparatuses.

For example, there is known as apparatus for applying coatings to surfaces of bodies utilizing detonation gas waves (cf., U.S. Pat. No. 3,150,828, Cl. 239–79, published 1964). This apparatus comprises sources of fuel gas, oxidant and inert gas, a gas distribution unit connected to these sources by way of gas conduit a gas flow restricting means having a gas conduit for connecting with the gas distribution unit, a powder sprayer, a barrel, a system for igniting the gases, and a cam mechanism cooperating with the gas distribution unit and with the gas ignition system. In this apparatus the gas distribution unit includes three valve arrangements, for each gas separately, each such valve arrangement comprising a valve having a valve head and a spring-loaded valve stem secured in a guide sleeve provided in the housing of the gas distribution unit. In order to ensure reliable valve operation and prevent gases from leaking through the guide sleeve and valve seat, it is necessary to provide a highly accurate fit of the valve stem in the sleeve and setting of the valve head on the valve seat. Opening and closing of the valves is done here by the cam mechanism in the form of two cams with substantially flat tappets, the cams being secured on a common shaft which also carries a belt drive pulley and a cam of the ignition system interrupter. Such a cam mechanism needs precise timing to adjust the working cycle. In addition, the housing of the gas distribution unit is provided with cavities to accommodate the valve heads in lifted position.

When inert gas is passed through these cavities, the velocity of gas flow drops to result in the formation of stagnation zones occupied by a mixture of inert gas and detonatable constituents, which prevents proper purging of the gas distribution unit. When feeding the constituents of detonatable mixture, oxidant and fuel gas are vigorously mixed with nitrogen present in the valve cavities, whereby a low quality mixture with retarding additions of inert gas (viz., nitrogen) is obtained. In order to obviate this disadvantage, it is necessary to increase the flow rates of both the inert gas to purge the oxidant and fuel gas from the valve cavities and the oxidant with the fuel gas to purge nitrogen from these cavities. Another disadvantage of such gas distribution resides in that the jet of gas flowing along the tapered generating line of the valve head actively mixes with the gases present in the valve cavity rather than sweeps them out.

In addition, the gas flow restricting means is connected to the barrel by means of two counter flow gas conduits, which fail to sweep the spent inert gases from the barrel when the detonatable mixture is admitted, but which promote mixing of detonatable constituents with the inert gases. This entails poor quality of the detonatable mixture, low purging efficiency, and inaccurately metered filling of the gas flow restricting means of the gas blanketing arrangement prior to detonation to result in increased flow of working gases, impaired efficiency of the apparatus and low quality coatings.

SUMMARY OF THE INVENTION

It is therefore an object of the present invention to obviate disadvantages inherent in the prior art devices and provide a novel and improved detonation-gas apparatus for applying coatings to surfaces of bodies.

Another object is to provide an apparatus which would use less working gases for its operation.

One more object is to provide an apparatus which would be highly efficient and ensure high quality coatings.

Yet another object is to provide an apparatus which would be simple in construction.

These and other objects and attending advantages are attained by that in a detonation-gas apparatus for applying coatings to surfaces of bodies comprising a barrel with a spark plug, a sprayer of powder materials arranged inside the barrel, sources of fuel gas, oxidant, and inert gas, a gas distribution unit connected to the gas sources, a gas flow restricting means communicating with the gas distribution unit and with the barrel, an ignition system for detonating the gases in the barrel, and a cam mechanism cooperating with the gas distribution unit and with the gas ignition system, according to the invention, the gas distribution unit includes a cylinder wall which is provided with radial ports arranged in three rows in terms of height thereof to communicate the interior of the cylinder with the gas sources, the cylinder having a headpiece with passages to convey the gases from the interior of the cylinder to the barrel through the gas flow restricting means, and a piston arranged in the interior of the cylinder to reciprocate and cooperate with the cam mechanism.

Thanks to such a structural arrangement, the inert gas conveyed from the source of inert gas to the barrel has along its travel path practically no stagnation zones and cavities of substantial capacity, because the only cavity in the cylinder above the piston has at this point in time a minimum volume determined by the intermediate position of the piston, and therefore the interior of the cylinder is easily purged by several gas streams flowing from the walls of the cylinder to the center of the headpiece. This in turn provides a possibility to use small quantities of inert gas for purging the detonation chamber subsequent to detonation and the gas flow restricting means prior to detonation, which results in improved purging efficiency. The constituents of the detonatable mixture, viz. oxidant and fuel gas, entering the barrel after the inert gas along the tubular gas conduits are admitted to the interior of the cylinder above the piston during the low position assumed by the piston when the cylinder interior is expanded; however, the volumes used for providing a detonatable mixture of these gases considerably exceed the volume of the cylinder interior, whereas the gas streams flowing from the walls of the cylinder to the center of the headpiece promptly sweep the remnants of nitrogen away. In addition, by virtue of the fact that the pressure of gases present in the cylinder interior is somewhat lower than that in the passages of the cylinder, gases at various pressures can freely pass therethrough; in other words, no resistance to the gases at lower pressures is produced. It is therefore possible to obtain a high-quality composition of the detonatable mixture containing negligeable amounts of foreign constituents which might weaken detonation.

Preferably, half of the ports in the row of ports remote from the headpiece communicate with the source of inert gas, whereas the other half of the ports in this row of ports communicate with the ports in the row of ports adjacent the headpiece; one port in the middle row of ports communicates with the source of fuel gas, whereas the other ports in this row of ports communicate with the source of oxidizing gas.

Thanks to such an arrangement, the constitutes of the detonatable mixture are fed to the ports of the middle row of ports of the cylinder at a pressure substantially below the pressure of the inert gas and invariably from above, whereas from below these detonatable constitutes are surrounded or blanketed by the inert gas to thereby prevent the escape of the detonatable mixture outside. This results in higher explosion safety and more efficient operation.

It is further advisable that the piston would have fitted thereon elastic seal rings end faces of which have the form of tapered concave surfaces, and interposed between these seal rings spacer rings and gas-valving rings end faces of which have the form of tapered convex surfaces corresponding to the tapered surfaces of the seal rings, the piston preferably carrying a nut adjacent the seal ring and serving to adjust a clearance between the cylinder and seal rings, the gas-valving ring also having a groove at the outer surface thereof to ensure the passage of inert gas from its source to the ports in the row of ports adjacent the headpiece of the cylinder.

By virtue of the above piston arrangement, it is possible to maintain a minimum clearance between the cylinder and seal rings of the piston to ensure free travel of the piston and prevent mixing of the constituents through this clearance. This results in an improved composition of the detonatable mixture of gases, which in turn enables to consume less amounts of working gases and obtain higher quality coatings.

Desirably, the gas distribution unit comprises a sealing connection of the piston with the headpiece of the cylinder formed by annular projections provided at the end face of the piston and annular recesses at the end face of the headpiece in the interior of the cylinder.

Such a sealing connection provides a local hydrodynamic resistance to soften the back-flash of gases propagating from the detonation chamber through the gas flow restricting means to the gas distribution unit resulting in a more efficient operation of the apparatus.

Favourably, the cam mechanism engageable with the piston comprises a cam of such a shape as to provide the travel of the piston to successively open and close the ports in the cylinder in accordance with the working cycle phases.

This arrangement makes it possible to dispense with bringing into synchronism several cams to adjust the cycle, since the sequence and timing of the cycle are guaranteed by the configuration of a single cam; a change in the rotational speed of the cam entails corresponding variations in timing. This is advantageous, because the frequency of detonation pulses can be varied within a wide range to again make the apparatus more efficient.

Advisably, the gas flow restricting means comprises gas conduits arranged tangentially to the cross-section of the barrel and communicating the interior of the cylinder through the passages of the headpiece with the barrel.

The tangential positioning of the inlet of the gas conduits in the detonation chamber of the barrel promotes the formation of a stable vortex flow of gases which acts to sweep by its wave front the spent and inert gases while failing to mix therewith behind the wave front line. It is for this reason that the detonatable mixture fed to the barrel contains negligible amounts of detonation-retarding ingredients, whereby high-power detonation pulses are developed to result in improved quality of coatings and higher production efficiency.

BRIEF DESCRIPTION OF THE DRAWINGS

The invention will now be described in greater detail with reference to a specific embodiment thereof taken in conjunction with the accompanying drawings, in which.

BEST MODE OF CARRYING OUT THE INVENTION

Description in the Statics

Figure 1:
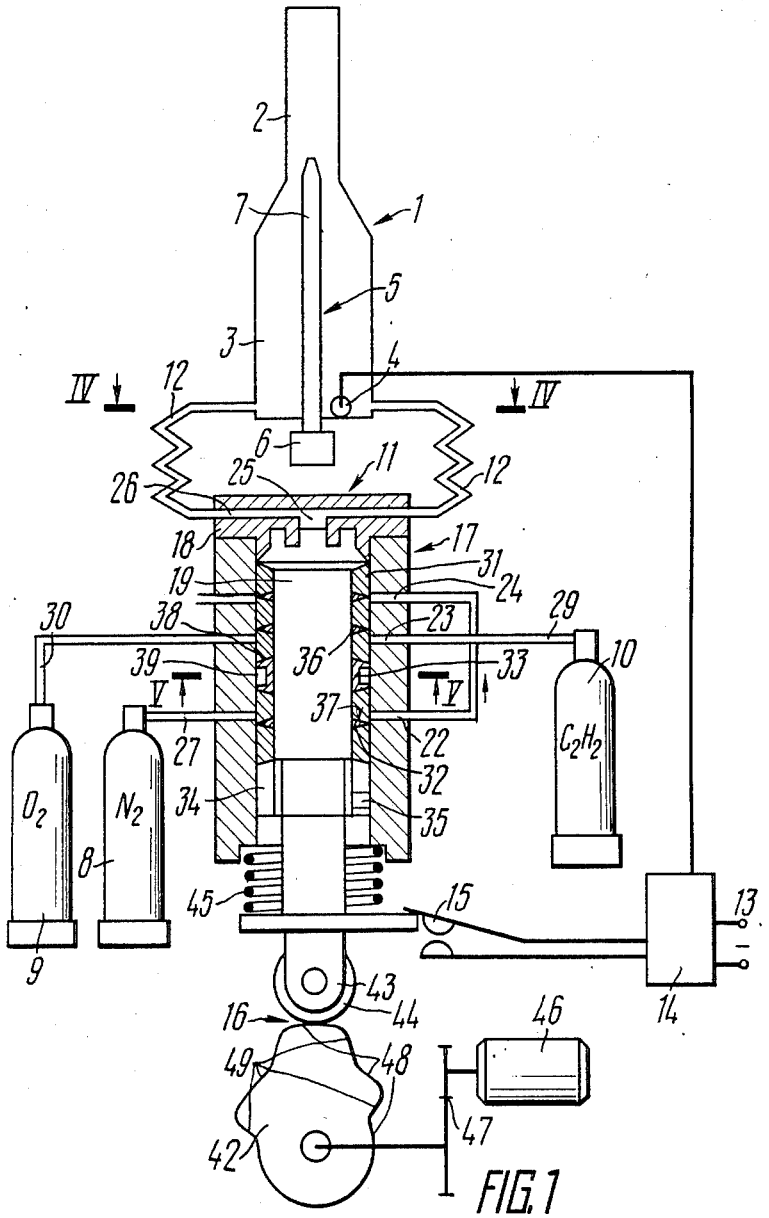
FIG. 1 is a longitudinal sectional view of a detonation-gas apparatus for applying coatings to surfaces of bodies according to the invention.

The proposed detonation-gas apparatus for applying coatings to surfaces of bodies represented in FIG. 1 comprises: a water-cooled barrel 1 having an acceleration portion 2 and a detonation chamber 3 accommodating a spark plug 4; a feeder 5 of powder materials including a metering means 6 and a sprayer 7 arranged inside the barrel 1; a source 8 of inert gas, a source 9 of oxidizing gas, and a source 10 of fuel gas; a gas distribution unit indicated at 11 and connected to the gas sources 8, 9 and 10; a gas flow restricting means 12 communicating with the gas distribution unit 11 and with the barrel 1; an ignition system for detonating gases in the barrel 1 including a direct current source 13, a voltage transformer 14, and a current interrupter 15 electrically wired to the spark plug 4; and a cam mechanism cooperating with the gas distribution unit 11 and gas ignition system.

Figure 2:
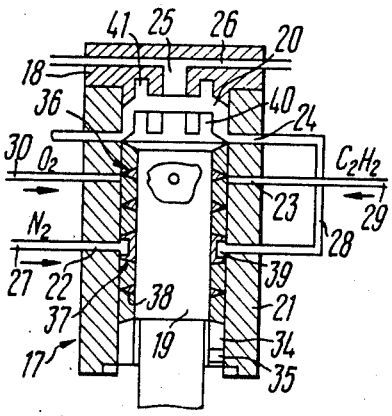
FIG. 2 is a longitudinal section illustrating the position of a piston in a cylinder during the admission of inert gas to the interior of the cylinder.
Figure 3:
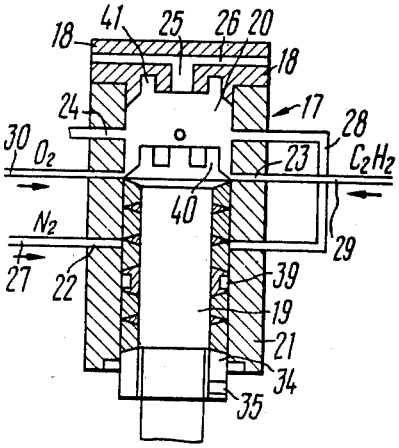
FIG. 3 is a longitudinal sectional view of the position assumed by the piston in the cylinder during the admission to the interior of the cylinder of fuel gas and oxidant.

According to one feature of the invention, the gas distribution system 11 comprises a cylinder 17 (FIGS. 2 and 3) terminating in a headpiece 18, and a piston 19 arranged in interior 20 of the cylinder 17 with a clearance to ensure that it reciprocates and cooperates with the cam mechanism 16.

Walls 21 of the cylinder 17 have radial ports 22, 23 and 24 communicating the interior 20 of the cylinder 17 with the gas sources 8, 9 and 10 and arranged in three rows in terms of the height of the cylinder 17. Each such row has at least two ports. Alternatively, each such row may include any even number of ports.

The headpiece 18 has a central passage 25 and radial passages 26 for the gases to flow from the interior 20 of the cylinder 17 to the barrel 1 through the flow restricting means 12.

Half of the ports 22 in the row of ports remote from the headpiece 18 communicate by way of a gas conduit 27 (FIG. 1) with the source 8 of inert gas, whereas the other half of the ports in this row communicate in pairs with the ports 24 in the row of ports adjacent the headpiece 18 by way of a gas conduit 28. One port 23 in the middle row of ports communicates through a gas conduit 29 with the source 10 of fuel gas, the other ports 23 of this middle row communicating by way of a gas conduit 30 with a source 9 of oxidizing gas.

Fitted on the piston 19 are seal rings 31, spacer rings 32 interposed between the seal rings 31, and a gas-valving ring 33, all these rings being drawn together by a nut 34 having a stop 35 and serving to adjust the clearance between the cylinder 17 and seal rings 31.

End faces 36 of the seal rings 31 have the form of concave tapered surfaces, whereas end faces 37 and 38 of the spacer rings 32 and gas-valving ring 33, respectively, have the form of convex tapered surfaces corresponding to the tapered surfaces of the end faces 36 of the seal rings 31. Provided at the outer surface of the gas-valving ring 33 is a groove 39 intended to ensure the passage of inert gas from the source 8 thereof to the ports 24 in the cylinder 17 adjacent the headpiece 18.

The gas distribution unit 11 comprises a sealing connection between the piston 19 and headpiece 18 of the cylinder 17 which is defined by annular projections 40 (FIGS. 2 and 3) provided at the end face of the piston 19, and annular recesses 41 made at the end face of the headpiece 18 in the interior 22 of the cylinder 17.

The cam mechanism 16 cooperating with the piston 19 includes a cam 42 (FIG. 1), a push rod 43 with a roller 44, and a spring 45. The cam 42 is rotated by an electric motor 46 through a reducing gear 47 and has a shape which ensures such a travel of the piston 19 as to successively open and close the ports 22, 23 and 24 in the cylinder 17 according to the working cycle phases, for which purpose it is defined by three arcuate surfaces 48 and four intermediate surface portions 49. Angles of the arcuate surfaces act to execute the cycle timing.

The flow restricting means 12 includes gas conduits 50 (FIG. 4) arranged tangentially to the cross-section of the barrel 1 and communicating the interior 20 of the cylinder 17 with the barrel 1 through the passages 25 and 26 of the headpiece 18.

Operating Principle

The proposed apparatus operates in the following manner.

Inert gas, oxidizing gas and fuel gas are admitted, as shown in FIG. 1, to the ports 22, 23 and 24 of the gas distribution unit 11 through the gas conduits 27, 29 and 30, respectively.

When the cam 42 is rotated, the piston 19 is caused to move down by the spring 45 to open the radial ports 24 in the row of ports adjacent the headpiece 18, while simultaneously registering the gas-valving ring 33 with the radial ports 22 in the row of ports remote from the headpiece 18. Thereafter, the piston 19 stops temporarily in the intermediate position, and within this space of time the inert gas $N_2$ (FIGS. 1 and 2) flows from the inert gas source 8 along the gas conduit 27 to the interior 20 of the cylinder 17, passes through the gas-valving ring 33 (FIG. 5) to escape from the interior 20 of the cylinder 17 and then be again received by the interior 20 of the cylinder 17 through the ports 24. The gas flows further along the passages 25 and 26 in the headpiece 18 of the cylinder 17 to be divided into two streams and enter through the flow restricting means 12 along the tangential conduits 50 (FIG. 4) the detonation chamber 3 of the barrel 1 (FIG. 1), where it is swirled to sweep by the stream front detonation gases out of the chamber and thus execute the purging phase.

Figure 4:
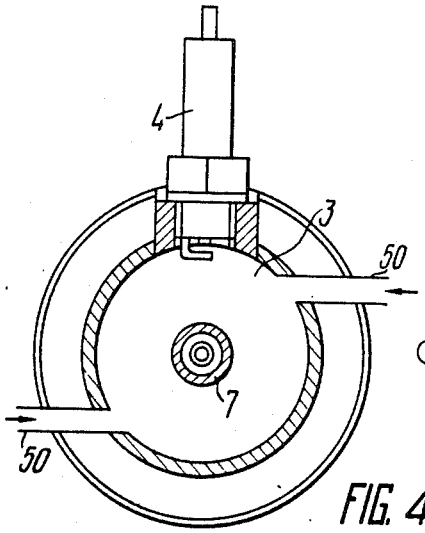
FIG. 4 is an enlarged section taken along the line IV—IV in FIG. 1.
Figure 5:
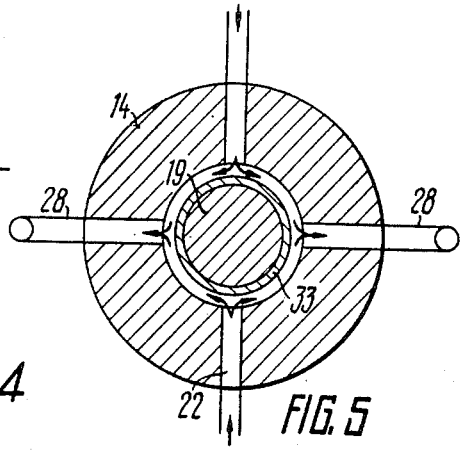
FIG. 5 is an enlarged view taken along the line V—V in FIG. 1.

The cam 42 continues to rotate, and the piston 19 is lowered a second time closing the ports 22 in the row of ports remote from the headpiece 18 to terminate the flow of the inert gas from the source 8 and, while opening the ports 23 in the middle row of ports, stops temporarily in the intermediate position (FIGS. 1 and 4). Within this space of time the oxidant and fuel gases flow along the gas conduits 29 and 30 to enter the interior 20 of the cylinder 17 to pass further along the passages 25,26 and flow restricting means 12 directly to the detonation chamber 3 of the barrel 1, where they are swirled to force by the stream from the purging gas from the chamber 3 to the acceleration portion 2 thus completing the phase of filling the detonation chamber 3 with the fuel mixture.

A still further rotation of the cam 42 causes the piston 19 to ascend, and while ascending to close the ports 23 in the middle row of ports, open the ports 24 in the row of ports adjacent the headpiece 18, and register the gas-valving ring 33 with the ports 22 in the row of ports remote from the headpiece 18. Then the piston 19 stops in the intermediate position (FIGS. 1, 2 and 5), whereby the spring 45 is compressed. During this space of time only the flow restricting means 12 is filled with the inert gas thus providing gas blanketing.

A subsequent rotation of the cam 42 makes the piston 19 ascend to close all the ports 22, 23 and 24 of the cylinder 17, stop the admission of gases, and mate the annular projection 40 with the annular recess 41 thus completing preparation procedures prior to detonation (FIG. 1). Concurrently, with the approach of the piston to the topmost position a lug of the pusher rod 43 forces the interrupter 15 to break the contact, whereby high voltage from the voltage transformer 14 is applied to the spark plug 4 to initiate detonation. Detonation is completed while the piston rests in the topmost position, and the powder material to be sprayed is heated and accelerated. The entire cycle is repeated after rotation of the cam 42.

A specific feature of the aforedescribed gas distribution system is advantageous in that the detonatable gases are fed to the middle row of gas ports in the cylinder at a pressure substantially below the pressure of the inert gas and always from above thus blanketing them from below by the inert gas. Such a construction of the proposed apparatus makes operation less explosion hazardous.

In order to change the frequency of detonation pulses, it is sufficient to vary the direct current voltage applied to the electric motor 30 and change the flow rate of gases accordingly. It is therefore possible to gradually attain the maximum frequency of detonation pulses to operate with the utmost efficiency.

What is claimed is:

1. A detonation-gas apparatus for applying coatings to surfaces of bodies, comprising:

(a) a barrel having an outlet;

(b) a spark plug accommodated inside said barrel;

(c) sprayer means for supplying powder materials to the inside of said barrel;

(d) sources of fuel gas, oxidizing gas and inert gas;

(e) gas flow restricting means for restricting the flow of fuel gas, oxidizing gas and inert gas to said barrel;

(f) an ignition system connected with the spark plug for actuating the spark plug to detonate said gases in said barrel;

(g) gas distribution means connected to said gas sources for distributing said gases through said gas flow restricting means to said barrel in a four-phase cycle in the order of said inert gas, said fuel and oxidizing gases, and said inert gas and shutting off the supply of all gases to said barrel, said gas distribution means including:

(i) a hollow cylinder extending in a lengthwise direction and open at opposite ends thereof;

(ii) radial ports arranged in three rows spaced along the lengthwise direction of the cylinder for providing communication between the interior of the cylinder and the gas sources;

(iii) a headpiece connected at a first open end of the cylinder, said headpiece including passage means for conveying the gases from the interior of the cylinder through the gas flow restricting means to the barrel; and (iv) a single piston reciprocably arranged in the interior of the cylinder in the lengthwise direction thereof; and (h) cam means for actuating the piston to selectively open and close the radial ports so as to selectively supply the gases to the interior of the cylinder and thereby to said barrel in said four-phase cycle, and to control the ignition system to actuate the spark plug to detonate the gases in the barrel.

2. A detonation-gas apparatus as defined in claim 1, in which half of said ports in a first row of said ports most remote from said headpiece communicate with said source of inert other half of said ports in said first row of ports communicate with said ports in a second row of ports most adjacent said headpiece, one said port in a third row of ports between said first row and said second row communicating with said source of fuel gas, the other ports in said third row of ports communicating with said source of oxidizing gas.

3. A detonation-gas apparatus as defined in claim 1, in which said piston has fitted thereon elastic seal rings upper and lower end faces of which have the form of tapered concave surfaces, and interposed between these seal rings spacer rings and gas-valving rings upper and lower end faces of which have the form of tapered convex surfaces corresponding to the tapered surfaces of the seal rings, the piston carring a nut adjacent one of said seal rings for compressing all of said rings in the lengthwise direction of said cylinder to thereby adjust a clearance between said cylinder and said seal rings in the radial direction of said cylinder, the gas-valving ring having a groove at the outer radial surface thereof providing the passage of inert gas from its source to the ports in said second row of ports most adjacent said headpiece of said cylinder.

4. A detonation-gas apparatus as defined in claim 1, in which said cam means includes a cam having a shape providing travel of said piston to successively and selectively open and close said ports in said cylinder in accordance with working cycle phases, a pusher having one end secured to said piston, a roller secured to an opposite end of said pusher and engaged by said cam, and means for biasing said roller into engagement with said cam.

5. A detonation-gas apparatus for applying coatings to surfaces of bodies, comprising:

(a) a barrel having an outlet;

(b) a spark plug accommodated inside said barrel;

(c) sprayer means for supplying powder materials to the inside of said barrel;

(d) sources of fuel gas, oxidizing gas and inert gas;

(e) gas flow restricting means for restricting the flow of fuel gas, oxidizing gas and inert gas to said barrel;

(f) an ignition system connected with the spark plug for actuating the spark plug to detonate said gases in said barrel;

(g) gas distribution means connected to said gas sources for distributing said gases through said gas flow restricting means to said barrel in a four-phase cycle in the order of said inert gas, said fuel and oxidizing gases, and said inert gas and shutting off the supply of all gases to said barrel, said gas distribution means including:

(i) a hollow cylinder extending in a lengthwise direction and open at opposite ends thereof;

(ii) radial ports arranged in three rows spaced along the lengthwise direction of the cylinder for providing communication between the interior of the cylinder and the gas sources;

(iii) a headpiece connected at a first open end of the cylinder, said headpiece including passage means for conveying the gases from the interior of the cylinder through the gas flow restricting means to the barrel;

(iv) a single piston reciprocably arranged in the interior of the cylinder in the lengthwise direction thereof; and (v) a sealing connection of said piston with said headpiece of said cylinder defined by annular projections provided at an end face of said piston and annular recesses provided at an end face of said headpiece of the interior of said cylinder; and (h) cam means for actuating the piston to selectively open and close the radial ports so as to selectively supply the gases to the interior of the cylinder and thereby to said barrel in said four-phase cycle, and to control the ignition system to actuate the spark plug to detonate the gases in the barrel.

6. A detonation-gas apparatus for applying coatings to surfaces of bodies, comprising:

(a) a barrel having an outlet;

(b) a spark plug accommodated inside said barrel;

(c) sprayer means for supplying powder materials to the inside of said barrel;

(d) sources of fuel gas, oxidizing gas and inert gas;

(e) gas flow restricting means for restricting the flow of fuel gas, oxidizing gas and inert gas to said barrel;

(f) an ignition system connected with the spark plug for actuating the spark plug to detonate said gases in said barrel;

(g) gas distribution means connected to said gas sources for distributing said gases through said gas flow restricting means to said barrel in a four-phase cycle in the order of said inert gas, said fuel and oxidizing gases, and said inert gas and shutting off the supply of all gases to said barrel, said gas distribution means including:

(i) a hollow cylinder extending in a lengthwise direction and open at opposite ends thereof;

(ii) radial ports arranged in three rows spaced along the lengthwise direction of the cylinder for providing communication between the interior of the cylinder and the gas sources;

(iii) a headpiece connected at a first open end of the cylinder, said headpiece including passage means for conveying the gases from the interior of the cylinder through the gas flow restricting means to the barrel; and (iv) a single piston reciprocably arranged in the interior of the cylinder in the lengthwise direction thereof; and (h) cam means for actuating the piston to selectively open and close the radial ports so as to selectively supply the gases to the interior of the cylinder and thereby to said barrel in said four-phase cycle, and to control the ignition system to actuate the spark plug to detonate the gases in the barrel; and (i) said gas flow restricting means including gas conduits arranged tangentially to the cross-section of said barrel and communicating said interior of the cylinder through passage means in said headpiece with said barrel.

* * * * *